US010903610B1

(12) United States Patent
He et al.

(10) Patent No.: US 10,903,610 B1
(45) Date of Patent: Jan. 26, 2021

(54) SELF-LOCK STRUCTURE OF ETHERNET CONNECTOR FOR VEHICLE

(71) Applicant: AMPHENOL EAST ASIA ELECTRONIC TECHNOLOGY (SHEN ZHEN) CO., LTD., Guangdong Province (CN)

(72) Inventors: Dan Ren He, Guangdong Province (CN); Jian Qiang Shen, Guangdong Province (CN)

(73) Assignee: AMPHENOL EAST ASIA ELECTRONIC TECHNOLOGY (SHEN ZHEN) CO., LTD., Shen Zhen (CN)

( * ) Notice: Subject to any disclaimer, the term of this patent is extended or adjusted under 35 U.S.C. 154(b) by 0 days.

(21) Appl. No.: 16/726,600

(22) Filed: Dec. 24, 2019

(51) Int. Cl.

| | |
|---|---|
| ***H01R 13/639*** | (2006.01) |
| ***H01R 24/64*** | (2011.01) |
| ***H01R 13/20*** | (2006.01) |
| ***H01R 13/514*** | (2006.01) |
| ***H01R 12/70*** | (2011.01) |
| *H01R 13/627* | (2006.01) |
| *H01R 13/629* | (2006.01) |

(52) U.S. Cl.
CPC ..... *H01R 24/64* (2013.01); *H01R 12/70* (2013.01); *H01R 13/20* (2013.01); *H01R 13/514* (2013.01); *H01R 13/639* (2013.01); *H01R 13/629* (2013.01); *H01R 13/6275* (2013.01); *H01R 2201/04* (2013.01)

(58) Field of Classification Search
CPC . H01R 13/6275; H01R 13/629; H01R 13/639
See application file for complete search history.

(56) References Cited

U.S. PATENT DOCUMENTS

| | | | | |
|---|---|---|---|---|
| 7,918,677 | B2 * | 4/2011 | Robert | H01R 13/6275 439/317 |
| 10,305,222 | B2 * | 5/2019 | Haller | G02B 6/3821 |
| 10,490,937 | B1 * | 11/2019 | Su | H01R 13/6277 |

* cited by examiner

*Primary Examiner* — Tho D Ta
(74) *Attorney, Agent, or Firm* — Muncy, Geissler, Olds & Lowe, P.C.

(57) ABSTRACT

A self-lock structure of Ethernet connector for vehicle, includes a plug self-lock member and a cable end socket self-lock member. When the plug self-lock member and the cable end socket self-lock member are at a first engagement stage, the fastener is inserted into the outer shell, the outer hanger is engaged with the first groove, the first protrusion, the second protrusion, and the inner hanger are engaged with the second groove, the third groove, and the fourth groove, respectively, and the elastic plate is not in a forced status. When the plug self-lock member and the cable end socket self-lock member are at a second engagement stage, the fastener is further inserted into the outer shell, and the first protrusion and the second protrusion are further engaged, respectively, and the elastic plate is in a forced status, enhancing the fastening stability.

3 Claims, 7 Drawing Sheets

SELF-LOCK STRUCTURE OF ETHERNET CONNECTOR FOR VEHICLE

BACKGROUND OF THE INVENTION

1. Field of the Invention

The present invention relates to connectors, and more particularly, to a self-lock structure of Ethernet connector for vehicle.

2. Description of the Related Art

An Ethernet connector usually binds several cables on the cable seat, so as to realize a simultaneous transmission operations of the cables. During the operation process, only one fastening structure is applied for binding the cables on the cable seat, which suffers an insufficient binding force upon the cables. Especially, for a high-speed Ethernet application (1G&10G), the volume of the components is required to be as smaller as possible. As a result, a single binding structure is unable to fulfill the demand upon the binding force in the vehicle industry. Also, the inner shell component is applied for providing an anti-interference function, which plays an important role for ensuring the high transmission efficiency of the high-speed Ethernet connector. Further, current Ethernet connectors are provided for a few types of operation environments, so that the scope of application is limited.

SUMMARY OF THE INVENTION

For resolving the issues above, an Ethernet connector for vehicle is disclosed. With an optimized structure, the self-binding force of the connector is improved.

For achieving the aforementioned objectives, a self-lock structure of Ethernet connector for vehicle is provided, comprising a plug self-lock member and a cable end socket self-lock member;

the plug self-lock member comprising a plug shell, a outer shell, a fastener, and a inner shell;

the cable end socket self-lock member comprising a cable end socket shell, a outer shell, a fastener, and a inner shell;

the plug shell comprising an inner hanger disposed on an inner side of a bottom portion of the plug shell; the cable end socket shell comprising an inner hanger disposed on an inner side of a bottom portion of the cable end socket;

the outer shell being formed in a tube shape, and comprising an elastic plate, a first groove, a second groove, a third groove, and a fourth groove; the elastic plate being disposed on a bottom portion of the outer shell; the first groove being disposed on a top portion of the outer shell; the second groove being disposed on a second end on a lateral portion of the outer shell; the third groove being disposed on a first end on the lateral portion of the outer shell; the fourth groove being disposed on a middle portion of the elastic plate;

the fastener being formed in a plate shape, and comprising a pillar, a first protrusion, a second protrusion, and a ramp; the pillar being provided in a number of two and disposed on two sides of the fastener, respectively; the first protrusion and the second protrusion being positioned on two sides of the fastener, with the first protrusion being disposed on a second end of the fastener and the second protrusion being disposed on a first end of the fastener; the ramp being disposed on an outer side of a bottom portion of the fastener;

the inner shell comprising an outer hanger; the outer hanger being disposed on a top portion of the inner shell; wherein when the plug self-lock member and the cable end socket self-lock member carry out a self-locking operation, the outer shell is mounted around the inner shell; the plug shell is mounted around a combination formed of the corresponding outer shell and the inner shell; and the cable end socket shell is mounted around a combination formed of the corresponding outer shell and the inner shell;

when the plug self-lock member and the cable end socket self-lock member are at a first engagement stage of self-lock, the fastener is inserted into the outer shell, the outer hanger is engaged with the first groove, the first protrusion is engaged with the second groove, the second protrusion is engaged with the third groove, the inner hanger is engaged with the fourth groove, and the elastic plate is not in a forced status;

when the plug self-lock member and the cable end socket self-lock member are at a second engagement stage of self-lock, the fastener is further inserted into the outer shell from the first engagement stage, the first protrusion is pushed to an edge of the fastener to be positioned and prevented from retreating, the second protrusion is pushed in to be engaged with the second groove, and the elastic plate is pressed by the ramp and in a forced status.

Preferably, in the Ethernet connector for vehicle in accordance with the embodiment of the present invention, when the plug self-lock member and the cable end socket self-lock member are at the first engagement stage, a first stage locking force is reached; when the plug self-lock member and the cable end socket self-lock member are at the second engagement stage, a second stage locking force is reached.

Preferably, in the Ethernet connector for vehicle in accordance with the embodiment of the present invention, the inner shell is a whole-masking shell.

With such configuration, the present invention achieves following advantages.

Compared with conventional arts, with optimized connector structure, the issue of an insufficient binding capability of the terminal module of the Ethernet connector for vehicle is resolved through following methods. A two-stage self-lock structure for the terminal module is provided, wherein the outer hanger is engaged with the first groove, and the inner hanger is engaged with the fourth groove, thereby achieving the self-locking effect upon the inner shell, the outer shell, and the shell form the top portion and the bottom portion. The first protrusion is engaged with the second groove, and the second protrusion is engaged with the third groove, thereby achieving the self-locking effect from two sides. Based on the structure above, the ramp is provided for pressing the elastic plate, so as to further improve the self-locking stability through the elastic plate.

DETAILED DESCRIPTION OF THE INVENTION

Figure 1:
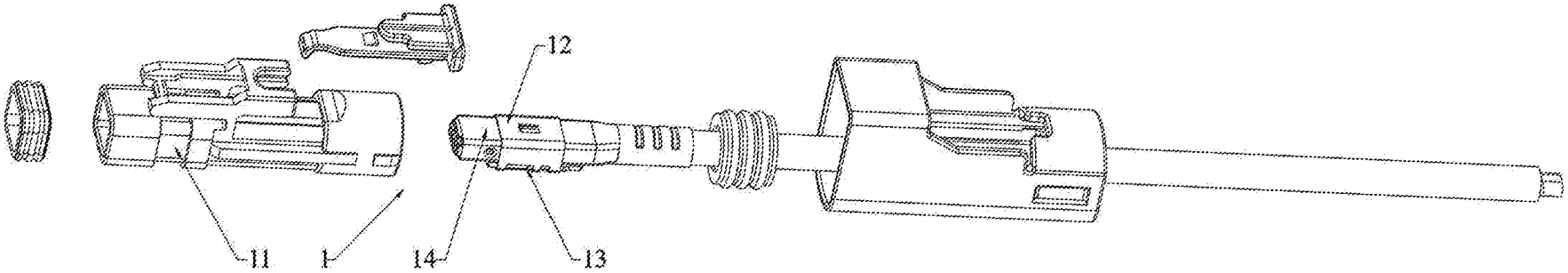
FIG. 1 is an exploded view of the plug self-lock member of Ethernet connector for vehicle in accordance with an embodiment of the present invention.
Figure 2:
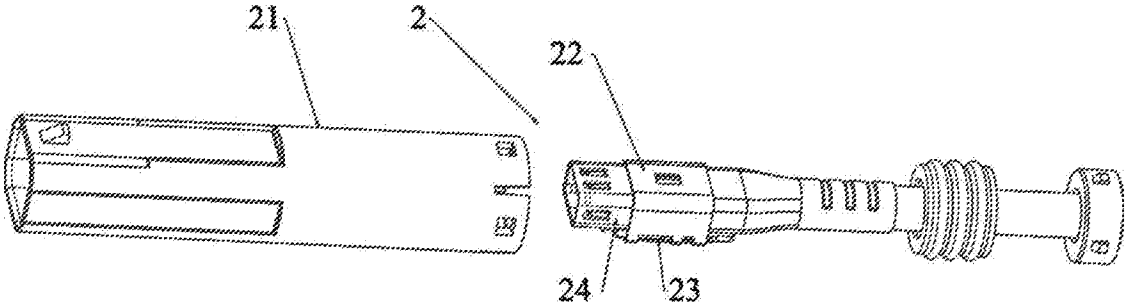
FIG. 2 is an exploded view of cable end socket self-lock member the self-lock member of Ethernet connector in accordance with an embodiment of the present invention.
Figure 3:
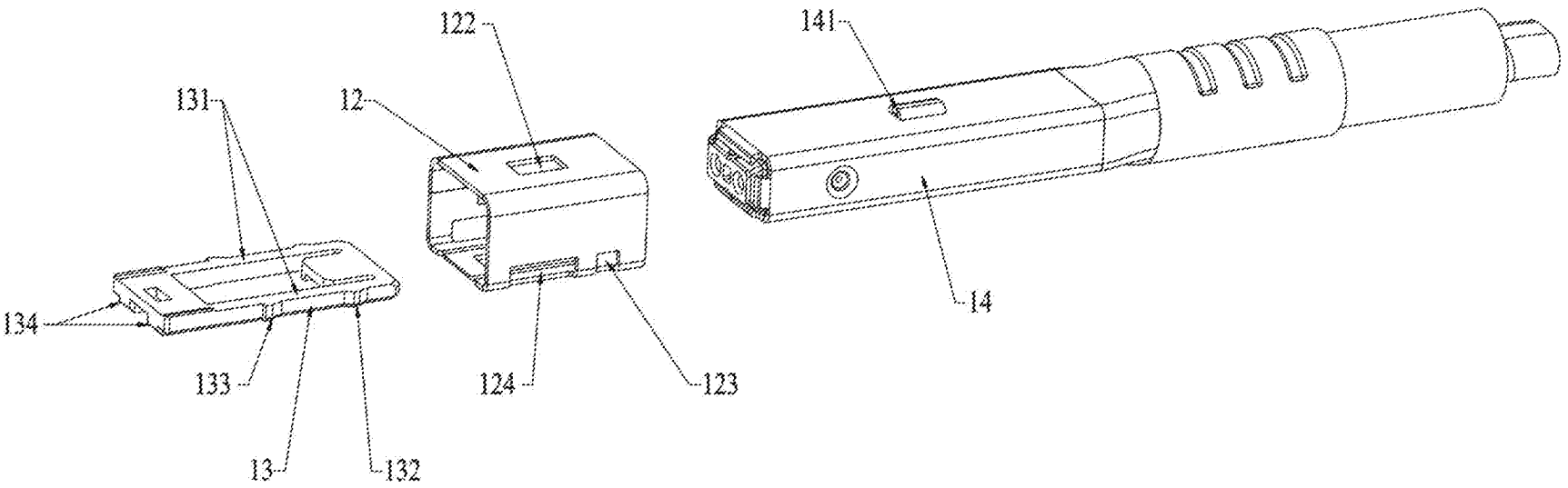
FIG. 3 is an exploded side view of the plug self-lock member.
Figure 4:
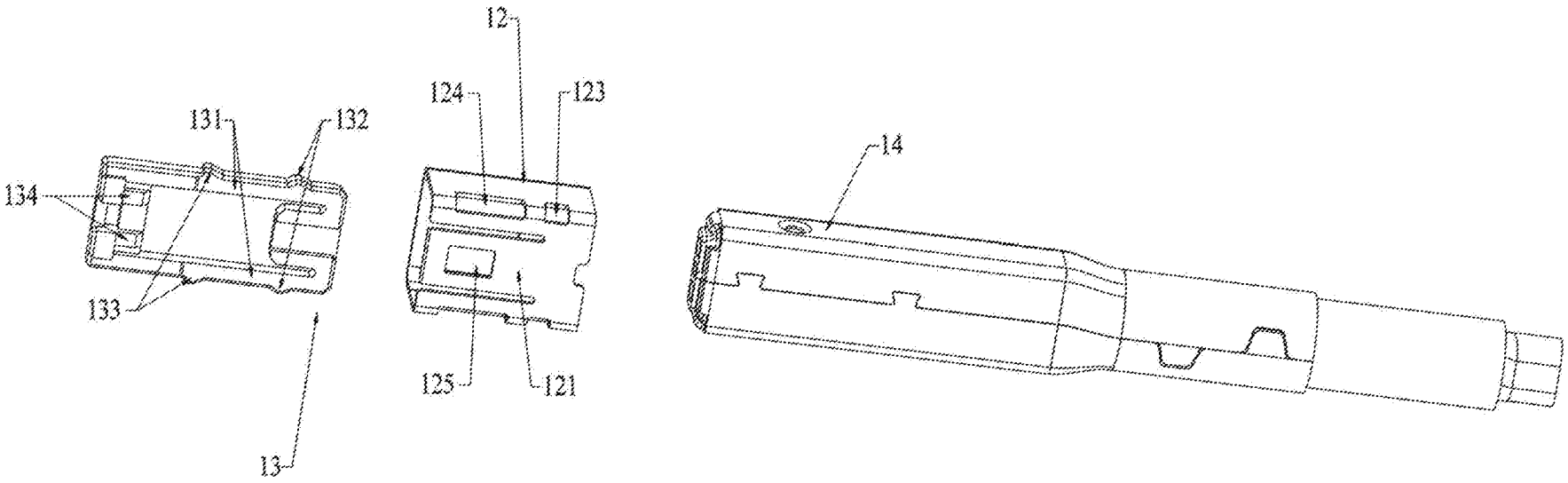
FIG. 4 is an exploded perspective bottom view of the plug self-lock member.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 11, specific embodiments are provided for illustrating but not limiting the features of the present invention.

Embodiment 1

A self-lock structure of Ethernet connector for vehicle is provided, referring to FIG. 1 to FIG. 4, FIG. 10 and FIG. 11, comprising a plug self-lock member 1 and a cable end socket self-lock member 2.

The plug self-lock member 1 comprises a plug shell 11, a outer shell 12, a fastener 13, and a inner shell 14.

The cable end socket self-lock member 2 comprises a cable end socket shell 21, a outer shell 22, a fastener 23, and a inner shell 24.

Figure 5:
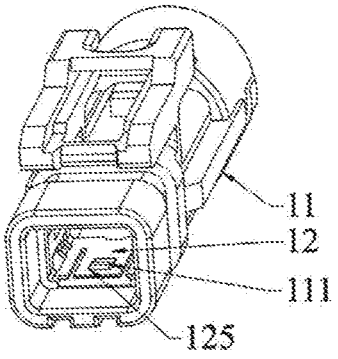
FIG. 5 is a schematic view illustrating the inner hanger of the plug shell being engaged with the fourth groove of the outer shell.
Figure 6:
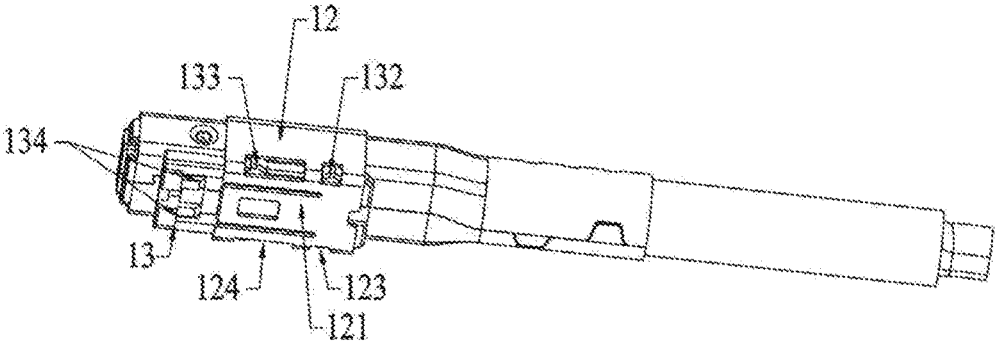
FIG. 6 is a schematic view illustrating the status of the first self-lock engagement stage of the plug excluding the shell.
Figure 7:
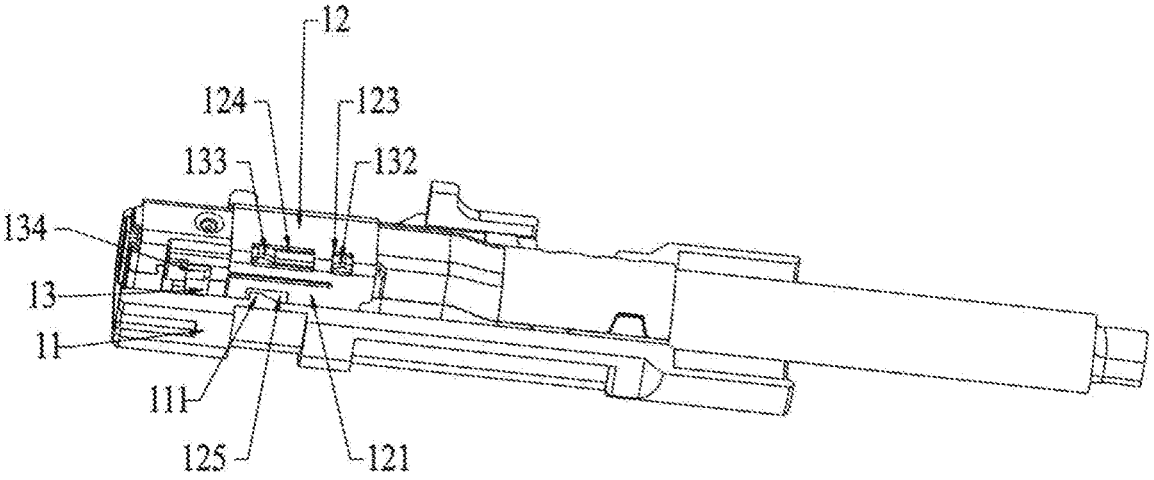
FIG. 7 is a schematic view illustrating the status of the first self-lock engagement stage of the plug including the shell.
Figure 8:
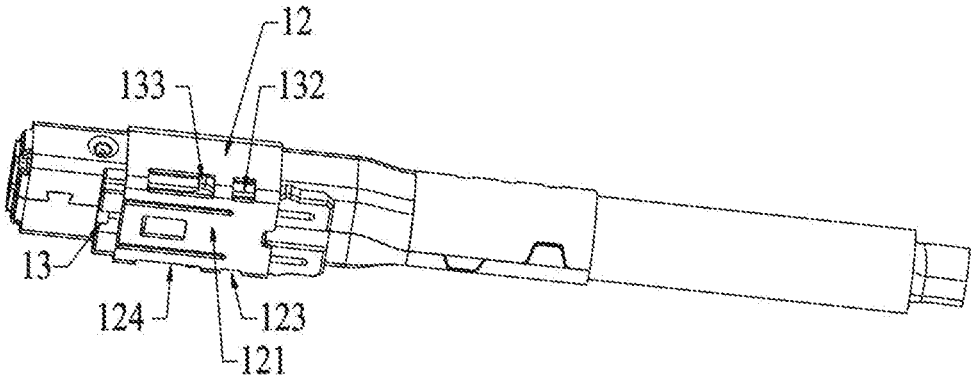
FIG. 8 is a schematic view illustrating the status of the second self-lock engagement stage of the plug excluding the shell.
Figure 9:
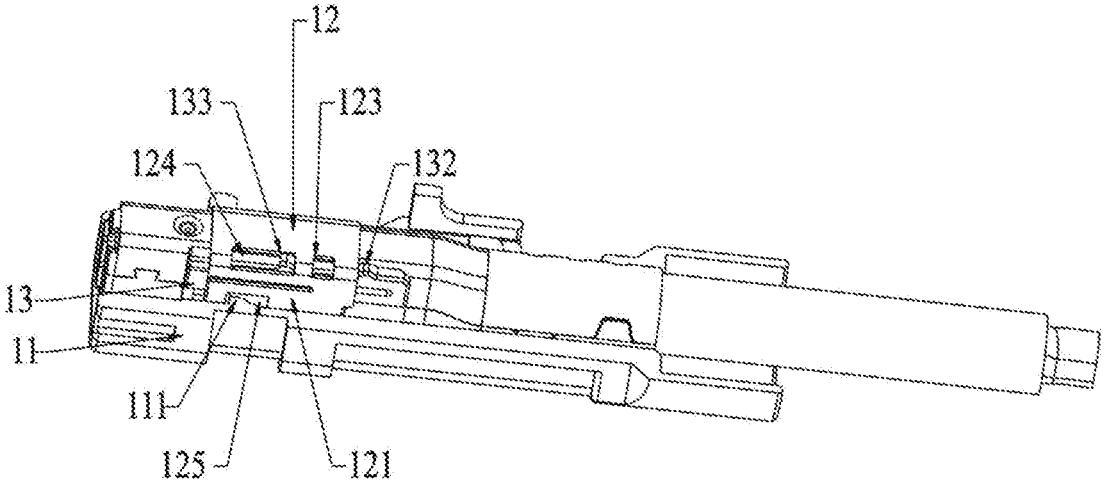
FIG. 9 is a schematic view illustrating the status of the second self-lock engagement stage of the plug including the shell.
Figure 10:
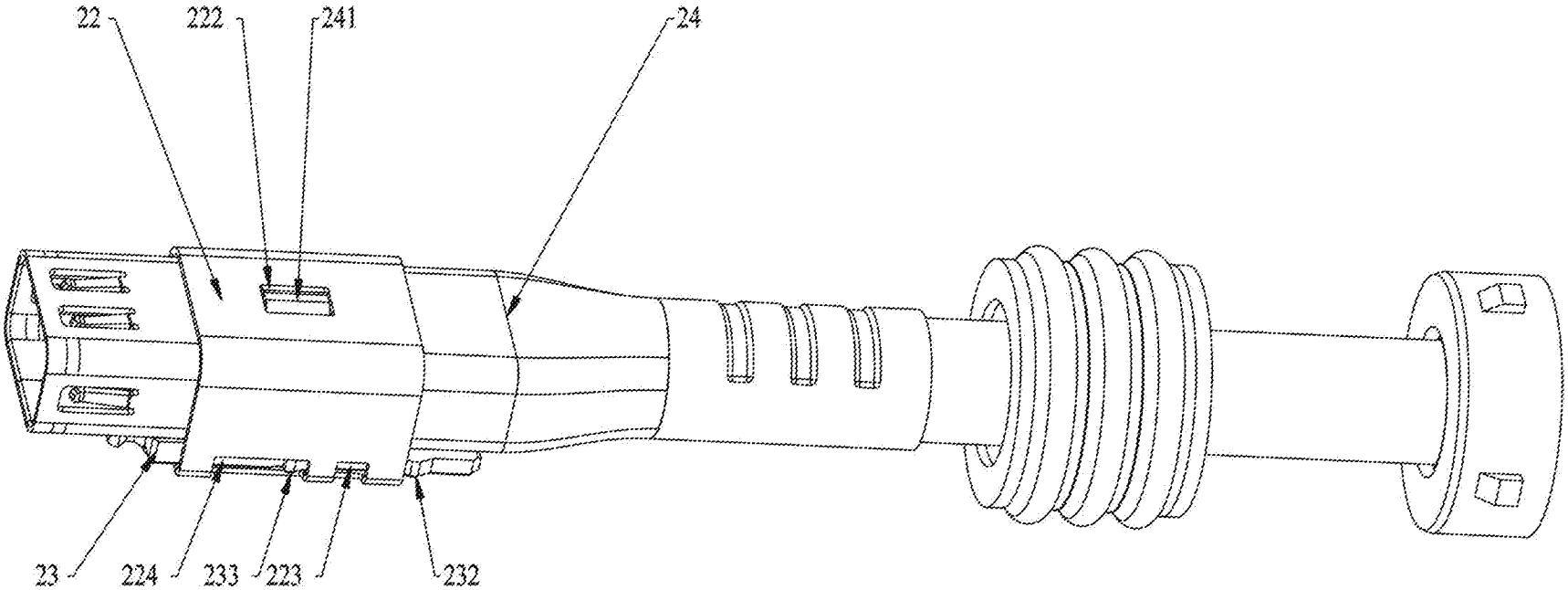
FIG. 10 is a schematic perspective top view illustrating the status of the second self-lock engagement stage of the cable end socket.
Figure 11:
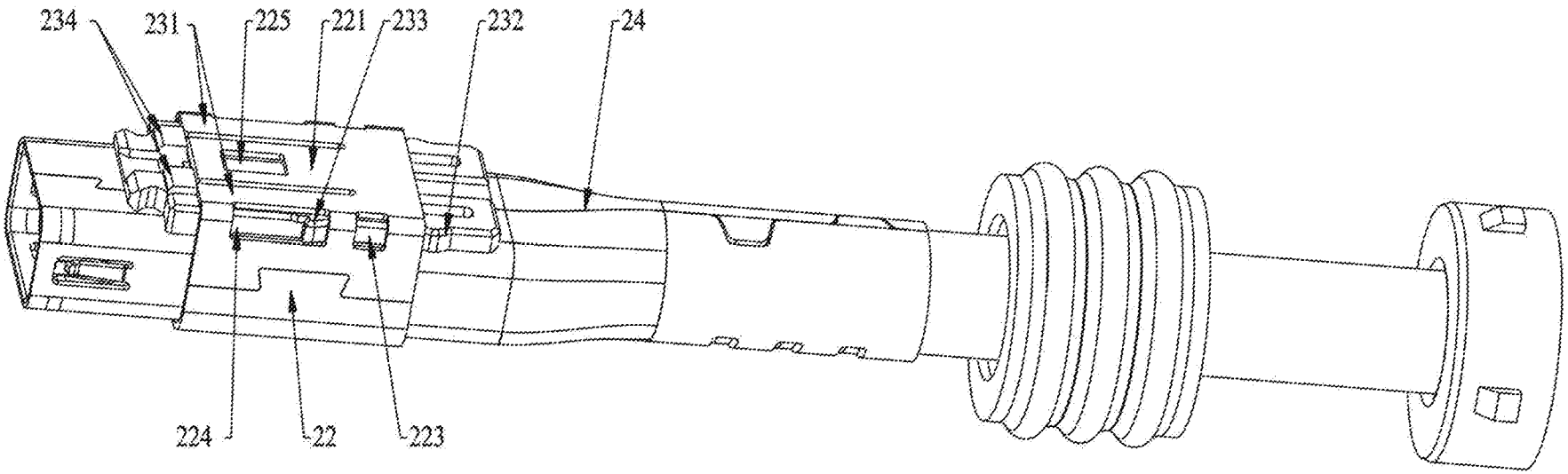
FIG. 11 is a schematic perspective bottom view illustrating the status of the second self-lock engagement stage of the cable end socket from the bottom side thereof.

Referring to FIG. 5, the plug shell 11 comprises an inner hanger 111 disposed on an inner side of a bottom portion of the plug shell 11; the cable end socket shell 21 comprises an inner hanger 211 disposed on an inner side of a bottom portion of the cable end socket shell 21.

The outer shell 12, 22 is formed in a tube shape, and comprise an elastic plate 121, 221, a first groove 122, 222, a second groove 123, 223, a third groove 124, 224, and a fourth groove 125, 225; the elastic plate 121, 221 is disposed on a bottom portion of the outer shell 12, 22; the first groove 122, 222 is disposed on a top portion of the outer shell 12, 22; the second groove 123, 223 is disposed on a second end on a lateral portion of the outer shell 12, 22; the third groove 124, 224 is disposed on a first end on the lateral portion of the outer shell 12, 22; the fourth groove 125, 225 is disposed on a middle portion of the elastic plate 121, 221.

The fastener 13, 23 is formed in a plate shape, and comprises a pillar 131, 231, a first protrusion 132, 232, a second protrusion 133, 233, and a ramp 134, 234; the pillar 131, 231 is provided in a number of two and disposed on two sides of the fastener 13, 23, respectively; the first protrusion 132, 232 and the second protrusion 133, 233 are positioned on two sides of the fastener 13, 23, with the first protrusion 132, 232 being disposed on a second end of the fastener 13, 23 and the second protrusion 133, 233 being disposed on a first end of the fastener 13, 23; the ramp 134, 234 is disposed on an outer side of a bottom portion of the fastener 13, 23.

The inner shell 14, 24 comprises an outer hanger 141, 241; the outer hanger 141, 241 is disposed on a top portion of the inner shell 14, 24.

When the plug self-lock member 1 and the cable end socket self-lock member 2 carry out a self-locking operation, respectively, the outer shell 12, 22 is mounted around the inner shell 14, 24; the plug shell 11 is mounted around a combination formed of the corresponding outer shell 12 and the inner shell 14; and the cable end socket shell 21 is mounted around a combination formed of the corresponding outer shell 22 and the inner shell 24.

When the plug self-lock member 1 and the cable end socket self-lock member 2 are at a first engagement stage, a first stage locking force is reached, as shown by FIG. 6, FIG. 7, FIG. 10, and FIG. 11; the fastener 13, 23 is inserted into the outer shell 12, 22, the outer hanger 141, 241 is engaged with the first groove 122, 222, the first protrusion 132, 232 is engaged with the second groove 123, 223, the second protrusion 133, 233 is engaged with the third groove 124, 224 for being prevented from retreating, as shown by FIG. 5, FIG. 7, FIG. 9, FIG. 10, and FIG. 11; the inner hanger 111, 211 is engaged with the fourth groove 125, 225, and the elastic plate 121, 221 is not in a forced status.

When the plug self-lock member 1 and the cable end socket self-lock member 2 are at a second engagement stage, a second stage locking force is reached, as shown by FIG. 2, FIG. 8, FIG. 9, FIG. 10, and FIG. 11; the fastener 13, 23, is further inserted into the outer shell 12, 22 from the first engagement stage, the first protrusion 132, 232 is pushed to an edge of the fastener 13, 23 to be positioned and prevented from retreating; the second protrusion 133, 233, is pushed to be engaged with the second groove 123, 223, and the elastic plate 121, 221 is pressed by the ramp 134, 234 in a forced status.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A self-lock structure of Ethernet connector for vehicle, comprising a plug self-lock member and a cable end socket self-lock member;

the plug self-lock member comprising a plug shell, an outer shell, a fastener, and an inner shell;

the cable end socket self-lock member comprising a cable end socket shell, an outer shell, a fastener, and an inner shell;

the plug shell comprising an inner hanger disposed on an inner side of a bottom portion of the plug shell; the cable end socket shell comprising an inner hanger disposed on an inner side of a bottom portion of the cable end socket shell;

each of the outer shell of the plug self-lock member and the cable end socket self-lock member being formed in a tube shape, and comprising an elastic plate, a first groove, a second groove, a third groove, and a fourth groove; the elastic plate being disposed on a bottom portion of the outer shell; the first groove being disposed on a top portion of the outer shell; the second groove being disposed on a second end on a lateral portion of the outer shell; the third groove being disposed on a first end on the lateral portion of the outer shell; the fourth groove being disposed on a middle portion of the elastic plate;

each of the fastener of the plug self-lock member and the cable end socket self-lock member being formed in a plate shape, and comprising a pillar, a first protrusion, a second protrusion, and a ramp; the pillar being provided in a number of two and disposed on two sides of the fastener, respectively; the first protrusion and the second protrusion being positioned on the two sides of the fastener, with the first protrusion being disposed on a second end of the fastener and the second protrusion being disposed on a first end of the fastener; the ramp being disposed on an outer side of a bottom portion of the fastener;

each of the inner shell of the plug self-lock member and the cable end socket self-lock member comprising an outer hanger; the outer hanger being disposed on an outer side of a top portion of the inner shell; wherein when the plug self-lock member and the cable end socket self-lock member carry out a self-locking operation, respectively, the outer shell of the plug self-lock member and the cable end socket self-lock member is mounted around the inner shell; the plug shell is mounted around a combination formed of the corresponding outer shell and the inner shell; and the cable end socket shell is mounted around a combination formed of the corresponding outer shell and the inner shell;

when the plug self-lock member and the cable end socket self-lock member are at a first engagement stage of self-lock, the fastener is inserted into the outer shell, the outer hanger is engaged with the first groove, the first protrusion is engaged with the second groove, the second protrusion is engaged with the third groove, the inner hanger is engaged with the fourth groove, and the elastic plate is not in a forced status;

when the plug self-lock member and the cable end socket self-lock member are at a second engagement stage of self-lock, the fastener is further inserted into the outer shell from the first engagement stage, the first protrusion is pushed to an edge of the fastener, the second protrusion is pushed in to be engaged with the second groove, and the elastic plate is pressed by the ramp and in a forced status.

2. The self-lock structure of Ethernet connector for vehicle of claim 1, wherein when the plug self-lock member and the cable end socket self-lock member are at the first engagement stage, a first stage locking force is reached; when the plug self-lock member and the cable end socket self-lock member are at the second engagement stage, a second stage locking force is reached.

3. The self-lock structure of Ethernet connector for vehicle of claim 1, the inner shell is a whole-masking shell.

* * * * *